United States Patent [19]

Simo

[11] Patent Number: 4,548,188

[45] Date of Patent: Oct. 22, 1985

[54] LATERALLY ADJUSTABLE ARROW REST FOR AN ARCHERY BOW

[76] Inventor: Miroslav A. Simo, 370 N. Delaplaine Rd., Riverside, Ill. 60546

[21] Appl. No.: 482,186

[22] Filed: Apr. 5, 1983

[51] Int. Cl.[4] ..... F41B 5/00

[52] U.S. Cl. ..... 124/41 A; 124/24 R

[58] Field of Search ..... 124/24 R, 41 A, 88

[56] References Cited

U.S. PATENT DOCUMENTS

| | | | |
|---|---|---|---|
| 3,108,584 | 10/1963 | Coe | 124/24 R |
| 3,232,286 | 2/1966 | Gayton | 124/41 A X |
| 3,292,607 | 12/1966 | Hoyt | 124/41 A |
| 3,482,563 | 12/1969 | Pint | 124/24 R |
| 3,757,764 | 9/1973 | Ikoya | 124/41 A |
| 3,769,956 | 11/1973 | Simo | 124/41 A |
| 3,828,757 | 8/1974 | Finlay | 124/41 A |
| 4,119,078 | 10/1978 | Wilson et al. | 124/41 A |

*Primary Examiner*—Richard J. Apley
*Assistant Examiner*—William R. Browne
*Attorney, Agent, or Firm*—Thomas W. Speckman

[57] ABSTRACT

An arrow rest for an archery bow which is readily laterally adjustable and has an arrow support which pivots upon movement of the arrow shaft and fletching across it and automatically returns to an initial predetermined position after discharge. The arrow rest mounts in a hole through the handle portion of the bow, provides easy lateral adjustment or complete replacement of the rest in the field.

33 Claims, 12 Drawing Figures

Fig. 9.
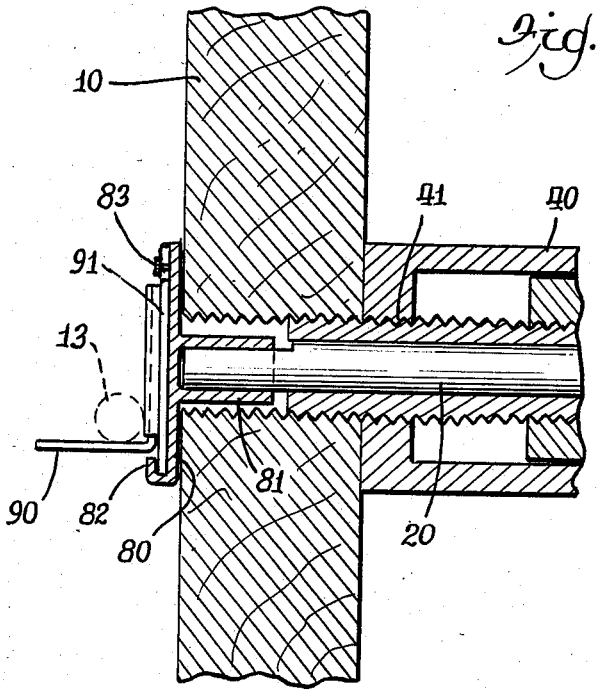
Fig. 13.
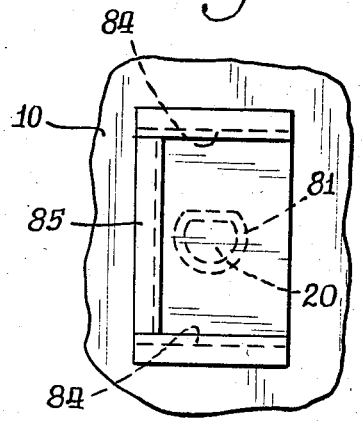
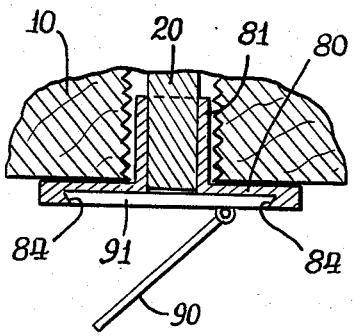
Fig. 11.
Fig. 10.
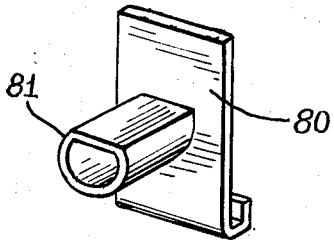
Fig. 12.
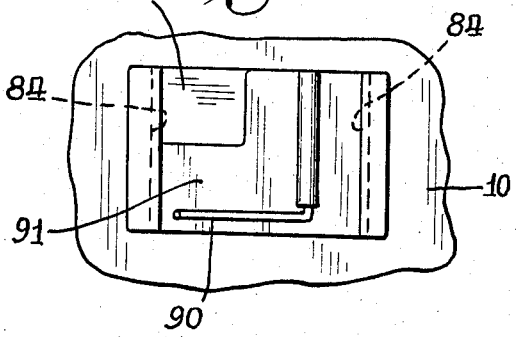

LATERALLY ADJUSTABLE ARROW REST FOR AN ARCHERY BOW

BACKGROUND OF THE INVENTION

1. Field of the Invention

This invention relates to an arrow rest for an archery bow, and more particularly to a laterally adjustable arrow rest with an arrow support that moves away from the fletching upon release of an arrow and automatically returns to its initial position after discharge. The lateral adjustment of the arrow rest may be readily achieved in the field and without the use of tools due to the nature of the mounting of the arrow rest through the handle area of the bow. The entire arrow rest of the present invention may be replaced in the field with assurance of correct positioning and alignment.

2. Description of the Prior Art

An arrow rest is generally secured to the handle area of an archery bow, and often includes a rigid notch or ledge which supports and guides an arrow as it is discharged from the bow. However, rigid arrow rests may introduce an undesirable vertical and horizontal force component to the arrow when the shaft and fletching passes over the arrow rest, causing an unwanted deflection of the arrow and damage to the fletching.

Flexible arrow rests which deflect both vertically and horizontally by spring action when the arrow passes over the arrow rest decrease this undesired deflection, as described in U.S. Pat. Nos. 4,074,674, 3,871,352, and 3,935,854. Spring biased arrow rests deflecting in a generally horizontal plane are described in U.S. Pat. Nos. 3,769,956 and 3,828,757. Also, arrow rests may be mechanically deflected away from the arrow when the arrow is shot, as described in U.S. Pat. No. 3,504,659.

An arrow may travel laterally with respect to the bow if the arrow rest is not properly aligned on the handle. Prior arrow rests which may be laterally adjusted require the use of tools or are rigid rests, as described in U.S. Pat. Nos. 3,285,237, 3,871,352, 3,232,286 and 3,757,764. A spring-biased plunger for lateral placement of an arrow on a fixed rest is described in U.S. Pat. No. 3,482,563.

Prior arrow rests have been secured to the bow handle area with adhesive, screws, or the like, and when replacement of the arrow rest is necessary due to breakage or wear, there is no assurance that the new arrow rest, even if of the same style as the old arrow rest, will be properly positioned for shooting without essentially complete realignment. The prior art does not suggest an arrow rest which may be easily laterally adjusted in the field without the use of tools and provide a movable arrow support arm which automatically returns to its initial position after discharge of the arrow.

SUMMARY OF THE INVENTION

It is an object of one embodiment of this invention to provide an arrow rest having an arrow support which may be deflected by movement of the shaft and fletching of an arrow and automatically returns to its initial position after discharge of the arrow.

Another object of this invention is to provide an arrow rest which may be adjusted laterally without the use of tools.

Yet another object of this invention is to provide an arrow rest which may be mounted and remounted in the same position with respect to the bow.

Another object of this invention is to provide an arrow rest which may be easily laterally adjusted in the field without tools and provide a deflectable arrow support which automatically returns to its initial position.

Still another object of this invention is to provide a laterally adjustable arrow rest wherein complete lateral adjustment can be achieved, that is, all the way to the bow handle without the thickness of a back plat or return mechanism.

The above objects are achieved in the present invention by an arrow rest having a receiving sleeve which has a first portion fixedly attachable within a transverse hole in the bow handle and an outer second portion sized to extend outwardly from the bow handle on the side away from the arrow rest when fixedly attached within the hole, the sleeve having a through opening. An elongated mounting means is adapted to fit non-rotatably but freely longitudinally movable within the sleeve through opening. The elongated mounting means has a first end adaptable to receive an arrow support means and an opposite second end extending from the receiving sleeve second portion through opening. An arrow support means is attached to the mounting means first end. An adjustment means engages the second end of the mounting means and the second portion of the receiving sleeve extending outwardly from the bow handle whereby movement of the adjustment means causes longitudinal movement of the mounting means within the receiving sleeve. The arrow support means may be a one-piece biased wire mounted in the end of the mounting means or a flat plate having a pivotable arrow support arm mounted on one side and the plate being removably attachable to a mating mounting attached to the end of the mounting means.

An important aspect of this invention is provision of an arrow rest having a pivotable arrow support arm which is moved out of the way by the arrow fletching and automatically returns to its initial position after discharge of the arrow. This is achieved by an elongated mounting means having means for retaining an arrow support wire in pivotable relation and means for retaining bias means for biasing the arrow support wire toward and at an initial predetermined position. A one-piece arrow support wire is provided having a generally vertical pivot portion retained in the support wire retaining means and a generally vertical bias portion spaced from the pivot portion and an arrow support portion extending beyond the end of the mounting means. Bias means are retained in the bias means retaining means and upon contacting the bias portion of the arrow support wire biases the bias portion toward a predetermined position. This construction provides a arrow support wire which deflects due to movement of the arrow shaft and fletching across it and automatically returns to its initial position after discharge of the arrow. This invention provides an arrow rest with full lateral adjustment, prior rests requiring thickness for spring mechanisms and mounting body preventing lateral adjustment to the bow surface.

BRIEF DESCRIPTION OF THE DRAWINGS

The above mentioned and other features of this invention and the manner of obtaining them will become more apparent, and the invention itself will be best understood by reference to the following description of specific embodiments of the invention taken in conjunction with the accompanying drawings, in which:

FIG. 9 is a partial cross-sectional view showing another embodiment of an arrow rest according to this invention;

FIG. 10 is a perspective rear view of the mating mounting shown in FIG. 9;

FIG. 11 is a top cross-sectional view of another embodiment of an arrow rest according to this invention;

FIG. 12 is a front view of the arrow rest shown in FIG. 11; and

FIG. 13 is a front view of another embodiment of a mating mounting according to this invention.

DESCRIPTION OF PREFERRED EMBODIMENTS

Figure 1:
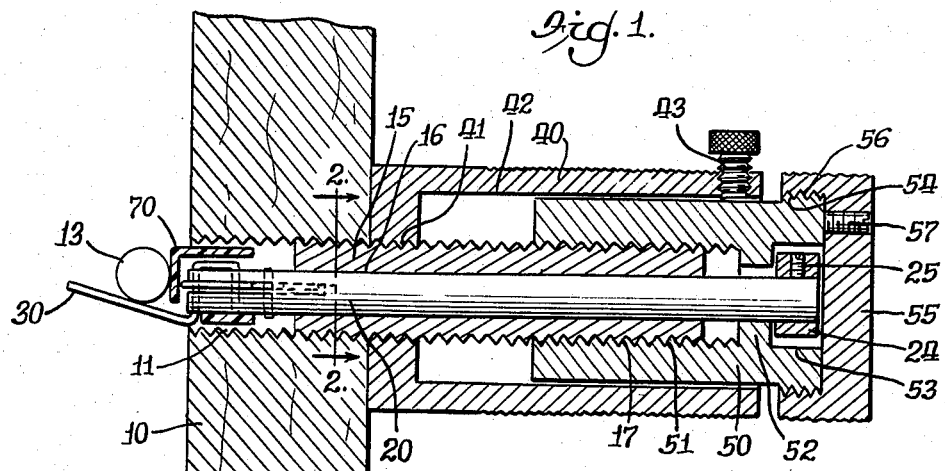
FIG. 1 is a cross-sectional view through a bow handle from the side of the archer showing one embodiment of an arrow rest of this invention.

FIG. 1 shows a laterally adjustable arrow rest having a movable arrow support which automatically returns to its initial position installed in through opening 11 in the handle-riser portion 10 of an archery bow. Receiving sleeve 15 is secured and maintained in fixed relation to the bow by sleeve external threads 17 engaging internal threads of through opening 11. Receiving sleeve 15 may be firmly held in position by receiving sleeve holding nut 40 having internal threads 41 engaging receiving sleeve external threads 17 and screwed tightly against the side of the bow handle. The exterior of receiving sleeve holding nut 40 may have flats for engagement of a wrench for tightening. When receiving sleeve holding nut is screwed tightly against the bow handle-riser portion, both receiving sleeve 15 and receiving sleeve holding nut 40 are firmly attached in fixed relation to the bow. It is preferred that receiving sleeve 15 extend at least halfway through the thickness of the bow handle to provide rigidity to the receiving sleeve and to provide longitudinal bearing surface for mounting means 20.

Figure 2:
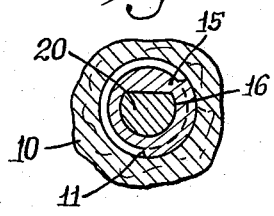
FIG. 2 is a cross-sectional view along line 2—2 in FIG. 1 showing one embodiment of a mounting means and receiving sleeve.
Figure 3:
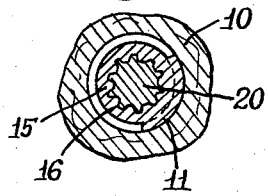
FIG. 3 is a cross-sectional view of another embodiment of a mounting means and receiving sleeve.

Mounting means 20 is of an elongated shape adapted to fit non-rotatably but freely longitudinally movable within receiving sleeve 15. Receiving sleeve 15 is provided with longitudinal through opening 16 which may be any suitable shape to provide non-rotatable fit and free longitudinal movement to mating elongated mounting means 20. Mounting means 20 extends beyond receiving sleeve 15 on both ends. Various shaped mounting means 20 and mating receiving sleeve through opening 16 may be used, as shown more clearly in the sectional views of FIGS. 2 and 3. The non-circular cross-sectional shape of mounting means 20 provides it non-rotatable and freely longitudinally movable fit within receiving sleeve through opening 16. FIG. 2 shows mounting means 20 to have a truncated circular cross section and FIG. 3 shows a splined shape for mounting means 20. It is readily apparent that other non-circular shapes would also be suitable.

In one embodiment of the invention, arrow support wire having an arrow support portion 30 is pivotably mounted in the end of mounting means 20 extending from receiving sleeve 15 toward the desired postion of arrow shaft 13. In another embodiment shown in FIGS. 9–13 mating mounting plate 80 is retained on the end of mounting means 20 by rubular fitting means 81 and a retractable arrow rest 90 having a flat plate 91 is firmly and replaceably retained in desired position on mating mounting plate 80. The opposite end of mounting means 20 extends sufficiently far to provide holding means, such as holding sleeve 24 for engagement with adjustment drive retainer ridge 52. Mounting means holding sleeve 24 is retained in fixed relation to mounting means 20 by any suitable locking means, such as locking screw 25.

Adjustment drive 50 has internal threads 51 engaging receiving sleeve external threads 17. Rotation of adjustment drive 50 causes lateral movement of the adjustment drive and due to holding means on the end of mounting means 20 being engaged with adjustment drive retainer ridge 52 causes mounting means 20 to move longitudinally within receiving sleeve 15. One suitable means of retaining adjustment drive 50 in a desired position is by providing locking screw 43 through a side wall of receiving sleeve holding nut 40. Receiving sleeve holding nut 40, as shown in FIG. 1, also provides receiving sleeve chamber 42 for general protection of the threaded portions of the arrow rest from the elements.

To provide easy replacement and assembly and disassembly of the arrow rest, adjustment drive 50 is provided with removable cap 55 which may be removed allowing access to removal of locking screw 25 and mounting means holding sleeve 24. After removal of mounting means holding sleeve 24, mounting means 20 may be readily pulled out of the opposite end of receiving sleeve 15. Adjustment drive removable cap 55 may be locked in position by any suitable means such as locking screw 57.

Figure 8:
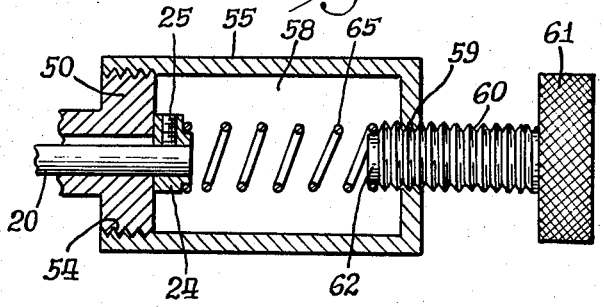
FIG. 8 is a side sectional view of another embodiment of the adjustment screw cap portion of an arrow rest providing longitudinal biased movement of the mounting means.

In the embodiment shown in FIG. 1, mounting means holding sleeve 24 allows rotation of adjustment drive 50 about it but substantially fills the length of holding sleeve chamber 53. Thus, longitudinal movement of mounting means 20 is controlled solely by longitudinal movement of adjustment drive 50 by engagement with the external threads of receiving sleeve 15. FIG. 8 shows another embodiment of retaining mounting means holding sleeve 24. As shown in FIG. 8, adjustment drive 50 is provided with removable cap 55 which forms chamber 58. The end of removable cap 55 has a hole with internal threads 59 for engagement with adjustment screw 60 provided with knurled hand portion 61. Spring 65 engages adjustment screw spring seat 62 at one end and the end of mounting means 20 or mounting means holding sleeve 24 at the other end. In this embodiment, in addition to mounting means 20 being adjustable longitudinally with respect to receiving sleeve 15, pressure on the opposite end of mounting means 20 may urge mounting means 20 longitudinally compressing spring 65 which returns mounting means 20 to its original position when the force on the other end is removed. The force necessary to urge mounting means against spring 65 is adjustable by rotation of adjustment screw 60.

One important embodiment of this invention provides a pivotable arrow support wire at one end of the elongated mounting means providing deflection upon an arrow shaft and fletching passing over the arrow support portion of the wire and a bias automatically returning the support wire to its initial predetermined position after discharge of the arrow. One embodiment is shown in a side view in FIG. 5 and a top view in FIG. 6 with the arrow support wire in its initial predetermined position denoted by I and deflected position denoted by the dashed shape of the wire in position II. The arrow support wire has generally vertical pivot portion 31 separated from generally vertical bias portion 33 by separation portion 32. Arrow support portion 30 of the support wire extends beyond the end of mounting means 20 and beyond the side of the bow 10 to receive arrow shaft 13. The bias spring has stationary portion 37 and movable portion 36 with the bias spring retained by pin 35 between these two portions. Bias spring stationary portion 37 rests upon spring holding face 22 in mounting means 20 and bias spring movable portion 36 is urged against bias portion 33 of the arrow support wire. The force of the bias may be controlled by the gauge of spring wire used or the flexibility of a sheet leaf-type spring. Pivoting of the arrow support portion of the arrow support wire from position I to position II increases the bias force in the spring. When the force of the arrow passing over the arrow support wire is terminated, the bias force in the spring applies force to bias portion 33 sufficient to return arrow support portion 30 to its original predetermined position adjacent arrow support wire return face 23.

It is readily apparent upon reading this disclosure that many embodiments using the principles described above for the pivotable arrow support would be suitable. For example, the arrow support wire may be pivoted on the portion of the wire denoted in FIG. 5 as 33 and return bias may be supplied to the portion of the arrow support wire denoted in the figure as 31. Likewise, separation portion 32 may be at the bottom of mounting means 20 instead of the top as shown. The bias spring means may be any suitable means supplying a bias force to the generally vertical portion of the arrow support wire which is not acting as the pivot portion for the pivotable arrow support. For example, it is only important that bias spring movable portion 36 be retained at one end to some type of retaining means, such as pin 35.

Figure 7:
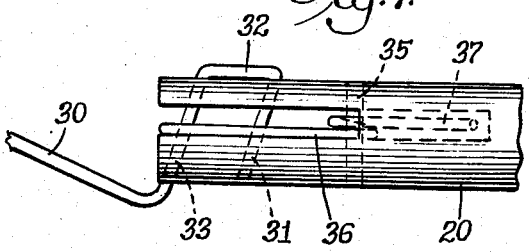
FIG. 7 is a side view of another embodiment of a mounting means showing a differently shaped arrow support wire.

Another embodiment of the arrow support wire according to this invention is shown in FIG. 7 wherein pivot portion 31 and bias portion 33 of the arrow support wire are at about a 20° angle to the vertical. This configuration is especially preferred since as arrow support portion 30 of the arrow support wire pivots toward position II a downward movement is induced to arrow support portion 30. By the terminology "generally vertical pivot portion" and "generally vertical bias portion" as used throughout this disclosure and in the appended claims, I mean within about 45° of the vertical and preferably within about 30° of the vertical, when the bow is in a vertical shooting position.

Figure 5:
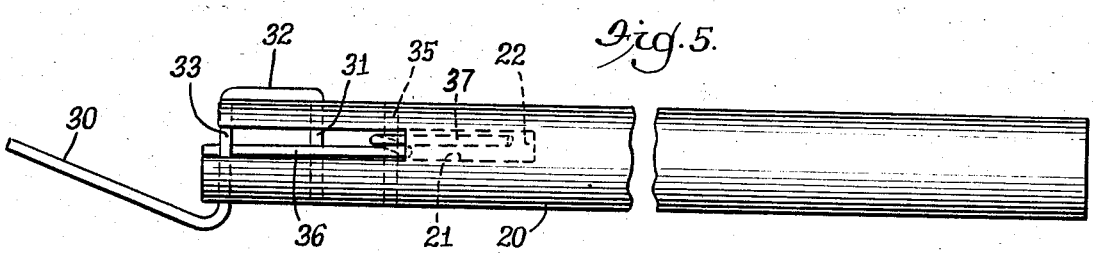
FIG. 5 is a side view of the mounting means shown in FIG. 1.
Figure 6:
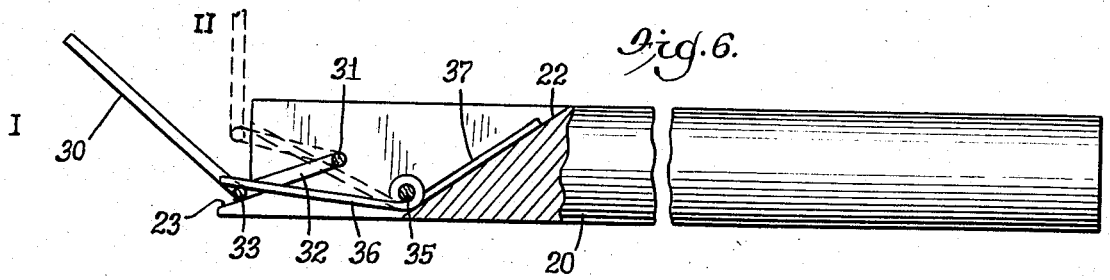
FIG. 6 is a top, partially sectioned view of the mounting means shown in FIG. 5.

The shape of the arrow support wire as shown in FIGS. 5 and 7 allows for some vertical deflection of arrow support portion 30 due to a thin spring-type wire being used. Arrow support portion 30 may be any desired shape to hold the arrow. Arrow support portion 30 of the arrow support wire may be covered by a sleeve or by material to reduce the frictional drag of the arrow shaft across the arrow support wire. Suitable materials include friction reducing plastics, such as fluorinated hydrocarbons (Teflon) or any other friction reducing materials known to the art.

One feature of the embodiments described above is the full lateral adjustment which is provided by the arrow rest of these embodiments. When deflected into position denoted as II in FIG. 6, arrow support arm 30 is against the side of the bow and there is no mechanism of the arrow rest projecting beyond the surface of the side of the bow.

Figure 4:
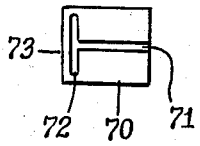
FIG. 4 is a bottom view of a mounting means cap.

Cap 70 provides a closure for the end of through opening 11 and by abutting against the end of mounting means 20 serves as a cushion and low friction surface for the arrow shaft. As shown in FIG. 4, cap 70 has longitudinal slot 71 to allow placement over bias portion 33 of arrow support wire and slot 72 allowing the desired movement of the arrow support wire. It is apparent that the shape and size of the slots may be altered to fit the desired arrow support wire motion. Cap 70 fits within the end of through opening 11 by friction and seats firmly against the end of mounting means 20 and may be maintained in position by a screw into the end of mounting means 20. Cap 70 may be made of plastic and end surface 73 coated with any suitable material to reduce the frictional drag of the arrow shaft.

In another embodiment of this invention shown in FIGS. 9 through 13, the arrow support means may be a conventional retractable arrow rest 90 mounted on flat plate 91, many such suitable arrow rests being well known to the art and previously adhered or otherwise fastened to the side of a bow. In this invention the flat plate of the arrow rest is removably, rigidly attached to one side of mating mounting plate 80, the other side of mating mounting plate 80 having tubular fitting means 81 snugly fitting over the end of mounting means 20 and may be maintained firmly in position be a screw into the end of mounting means 20. One embodiment of a suitable mating mounting plate is shown in FIGS. 9 and 10 wherein mounting plate 80 has lip holding means 82 along the bottom edge and undercut bottom holding means 83 extending through elongated holes in flat plate 91 to hold the retractable arrow rest flat plate 91 firmly in position. Thus, the retractable arrow rest may be readily replaced and assuredly positioned in the same position on mating mounting plate 80. Any suitable means for holding the retractable arrow rest to mounting plate 80 may be used. Another means of holding retractable arrow rest flat plate 91 is shown in FIGS. 11 and 12 wherein opposing sides have undercut edges 84 which mate with opposing sides of flat plate 91. In a similar fashion as shown in FIG. 13, the retractable arrow rest may be slid sideways into mating mounting plate having undercut top and bottom edges 84 and front stop 85. Utilizing this embodiment of attachment of conventional arrow rests to the end of mounting means 20 provides a wide variety of choice in use of conventional arrow rests which may be laterally adjusted, the different types of retractable arrow rests being fitted by modification of mating mounting plate 80 in any appropriate method which will be readily apparent upon reading of this disclosure.

The components of the arrow rest of this invention may be constructed of suitable materials providing durability and weather-resistance. Suitable metals and moldable plastics will be readily apparent. The bias spring means and arrow support wire are preferably fabricated from stainless steel or other corrosion resistant material.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrow rest laterally adjustable with respect to a bow upon which it is mounted and having a pivotable arrow support arm which pivots forwardly upon release of an arrow and automatically returns to its initial position after discharge of an arrow comprising:

a receiving sleeve having a first portion fixedly attachable within a transverse through hole in a bow handle and an outer second portion sized to extend outwardly from said bow handle on the side away from said arrow in shooting position when fixedly attached in said through hole, said sleeve having a through opening;

an elongated mounting means adapted to fit non-rotatably and freely longitudinally movable within said sleeve through opening and having a first end extending from said receiving sleeve first portion and adapted to receive an arrow support means and having an opposite second end extending from said receiving sleeve second portion end of said sleeve through opening;

an arrow support means attached to said mounting means first end, said arrow support means comprising a pivotal arrow support arm and spring means capable of urging said arrow support arm to said initial position;

adjustment means engaging said second end of said mounting means and engaging said second portion of said receiving sleeve, movement of said adjustment means moving said mounting means longitudinally within said receiving sleeve.

2. The arrow rest of claim 1 wherein said receiving sleeve first portion has external threads engageable with mating threads in said through hole in said bow handle and wherein said receiving sleeve is secured in position by a holding nut which engages said receiving sleeve external threads and abuts said bow handle.

3. The arrow rest of claim 2 wherein said second end of said mounting means is fitted with a holding sleeve, said holding sleeve non-longitudinally movable on said mounting means.

4. The arrow rest of claim 3 wherein said adjustment means comprises an adjustment drive having internal threads engageable with said receiving sleeve external threads and having a retainer ridge engageable with said holding sleeve.

5. The arrow rest of claim 4 wherein said adjustment means further comprises locking means for locking said adjustment drive with respect to said receiving sleeve.

6. The arrow rest of claim 4 wherein said adjustment means comprises a removable cap forming a holding sleeve chamber and providing an exterior grasping surface.

7. The arrow rest of claim 1 wherein said receiving sleeve has a truncated circular cross section.

8. The arrow rest of claim 1 wherein said second end of said mounting means is fitted with a holding sleeve, said holding sleeve longitudinally stationary on said mounting means.

9. The arrow rest of claim 1 wherein said arrow support means is a pivotably mounted arrow support means having a bias means for biasing an arrow support arm toward a predetermined position comprising a one-piece arrow support wire having a generally vertical pivot portion, a generally vertical bias portion spaced from said pivot portion, and an arrow support arm portion extending beyond the end of said mounting means.

10. The arrow rest of claim 9 wherein said bias means comprises spring means contacting said bias portion and wherein said spring means comprises a movable portion adjacent said arrow support wire bias portion, a central holding portion, and a stationary portion extending from said central holding portion in a generally opposite direction than said movable portion.

11. The arrow rest of claim 10 wherein said mounting means comprises a spring holding face against which said spring stationary portion abuts.

12. The arrow rest of claim 9 wherein said mounting means comprises a return face against which said bias portion abuts in said predetermined initial position.

13. The arrow rest of claim 9 wherein said pivot portion and said bias portion are at an angle to the vertical of up to about 45°.

14. The arrow rest of claim 9 wherein said bias portion is toward the end of said mounting means from said pivot portion.

15. The arrow rest of claim 9 wherein said pivot portion is toward the end of said mounting means from said bias portion.

16. The arrow rest of claim 9 wherein the end of said through hole in said bow handle adjacent said arrow support wire is covered by a cap.

17. The arrow rest of claim 1 wherein said arrow support means comprises a flat plate having said pivotable arrow support arm mounted on one side, said flat plate removably attachable to a mating mounting attached to said mounting means first end.

18. The arrow rest of claim 17 wherein said mating mounting comprises mating means on one side and tubular means on the other side, said tubular means fitting snugly over said mounting means first end.

19. The arrow rest of claim 18 wherein said mating means comprises a lip holding said flat plate along one edge.

20. The arrow rest of claim 18 wherein said mating means comprises undercut edges along opposing sides holding said flat plate under said undercut edges.

21. The arrow rest of claim 1 wherein said pivotal arrow support arm comprises a one-piece arrow support wire having a pivot portion mounted at an angle to a bow and an arrow support arm portion for supporting an arrow, said mounting of said pivot portion at said angle causing an arrow support arm portion to move forwardly and downwardly upon release of an arrow.

22. The arrow rest of claim 21 wherein said angle to a bow is up to about 45°.

23. The arrow rest of claim 21 wherein said angle to a bow is up to about 30°.

24. The arrow rest of claim 21 wherein said angle is up to about 45° to a plane including a bow and a bow string.

25. In an arrow rest for attachment to the handle portion of a bow and support of an arrow and having a forwardly pivotable arrow support arm which automatically returns to its intial position after discharge of an arrow and a mounting means having means for retaining an arrow support wire and means for retaining bias means for biasing said arrow support wire toward an initial predetermined position, the improvement comprising: said arrow support wire including said one-piece arrow support wire having a pivot portion retained by said support wire retaining means at an angle to a bow causing an arrow support portion extending beyond the end of said mounting means to move forwardly and downwardly upon release of an arrow; and bias means retained by said bias means retaining means and contacting said arrow support wire biasing said arrow support toward a predetermined initial position.

26. The arrow rest of claim 25 wherein said mounting means comprises a return face against which said bias portion abuts in said predetermined initial position.

27. The arrow rest of claim 26 wherein said bias means comprises spring means contacting said bias portion and having a movable portion adjacent an arrow support wire bias portion, a central holding portion, and a stationary portion extending from said central holding portion in a generally opposite direction than said movable portion.

28. The arrow rest of claim 27 wherein said mounting means comprises a spring holding face against which said spring stationary portion abuts.

29. The arrow rest of claim 25 wherein said angle to said bow is up to about 45°.

30. The arrow rest of claim 25 wherein a bias portion is toward the end of said mounting means from said pivot portion.

31. The arrow rest of claim 25 wherein said pivot portion is toward the end of said mounting means from a bias portion.

32. The arrow rest of claim 25 wherein said arrow support portion comprises a friction reducing surface.

33. The arrow rest of claim 25 wherein said angle is up to about 45° to a plane of a bow and a bow string.

* * * * *